US009441502B2

(12) United States Patent
Gbadebo et al.

(10) Patent No.: US 9,441,502 B2
(45) Date of Patent: Sep. 13, 2016

(54) GAS TURBINE ANNULAR DIFFUSOR

(75) Inventors: Semiu Gbadebo, Lincoln (GB); Yan Sheng Li, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 741 days.

(21) Appl. No.: 13/880,085

(22) PCT Filed: Sep. 7, 2011

(86) PCT No.: PCT/EP2011/065461

§ 371 (c)(1),
(2), (4) Date: Apr. 18, 2013

(87) PCT Pub. No.: WO2012/052220

PCT Pub. Date: Apr. 26, 2012

(65) Prior Publication Data

US 2013/0209246 A1 Aug. 15, 2013

(30) Foreign Application Priority Data

Oct. 18, 2010 (EP) ..... 10187887

(51) Int. Cl.
*F01D 25/30* (2006.01)
*F01D 5/14* (2006.01)
*F01D 25/16* (2006.01)

(52) U.S. Cl.
CPC ..... *F01D 25/30* (2013.01); *F01D 5/141* (2013.01); *F01D 25/162* (2013.01); (Continued)

(58) Field of Classification Search
CPC ..... F01D 5/141; F01D 5/145; F01D 25/30; F04D 29/54; F04D 29/541; F04D 29/542; F04D 29/544
See application file for complete search history.

(56) References Cited

U.S. PATENT DOCUMENTS 5,088,892 A * 2/1992 Weingold ..... F01D 5/145 415/193
5,338,151 A 8/1994 Frank
(Continued)

FOREIGN PATENT DOCUMENTS

CN 101563526 A 10/2009
CN 101852104 A 10/2010
(Continued)

OTHER PUBLICATIONS

Wadia, A. R., Szucs, P. N., Crall, D. W., 1997, 'Inner Workings of Aerodynamic Sweep', ASME Paper 97-GT-401, International Gas Turbine & Aeroengine Congress & Exhibition, Orlando, Florida.; 1997.

(Continued)

*Primary Examiner* — Craig Kim
*Assistant Examiner* — Brian O Peters

(57) ABSTRACT

Described is a gas turbine diffuser (300) comprising a strut (302) with a leading edge (304) extending between a first wall portion (308*a*) and a second wall portion (308*b*), wherein a first edge portion (304*a*) of the leading edge (304) is inclined towards a diffuser section outlet (326), i.e. in flow direction (328) of an exhaust stream, with regard to a normal direction (319*a*) perpendicular to the first wall portion (308*a*) at a first leading end point (320*a*) at which the leading edge (304) meets the first wall portion (308). Hence the leading edge (304) is partially inclined towards a diffuser section outlet (326).

7 Claims, 8 Drawing Sheets

(52) U.S. Cl.
CPC .. *F05D 2240/121* (2013.01); *F05D 2240/122* (2013.01); *F05D 2240/303* (2013.01); *F05D 2240/304* (2013.01); *F05D 2250/314* (2013.01); *F05D 2250/712* (2013.01)

(56) References Cited

U.S. PATENT DOCUMENTS

| | | | |
|---|---|---|---|
| 5,338,155 | A | 8/1994 | Kreitmeier |
| 6,079,948 | A | 6/2000 | Sasake |
| 6,554,564 | B1 | 4/2003 | Lord |
| 6,554,569 | B2 | 4/2003 | Breeze-Stringfellow |
| 6,866,479 | B2 | 3/2005 | Takahashi |
| 2004/0228726 | A1 | 11/2004 | Takahashi |

FOREIGN PATENT DOCUMENTS

| | | | |
|---|---|---|---|
| DE | 102008060847 | A1 | 6/2010 |
| EP | 0417433 | B1 | 6/1993 |
| EP | 0661413 | A1 | 7/1995 |
| EP | 0589215 | B1 | 11/1996 |
| EP | 0833060 | A2 | 4/1998 |
| EP | 1731734 | A2 | 12/2006 |
| EP | 1862644 | B1 | 11/2009 |
| RU | 2096631 | C1 | 11/1997 |
| WO | WO 2009119126 | A1 | 10/2009 |

OTHER PUBLICATIONS

Gallimore, S. J., Bolger, J. J., Cumpsty, N. A., Taylor, M. J., Wright, P. I., Place, J. M. M., 2002, "The Use of Sweep and Dihedral in Multistage Axial Flow Compressor Blading-Part 1: University Research and Methods Development", ASME Journal of Turbomachinery vol. 124, No. 4., p. 521-532.; 2002.

Gallimore, S. J., Bolger, J. J., Cumpsty, N. A., Taylor, M. J., Wright, P. I., Place, J. M. M., 2002, The Use of Sweep and Dihedral in Multistage Axial Flow Compressor Blading-Part 2: Low and High-Speed Designs and Test Verification, ASME Journal of Turbomachinery, vol. 124, No. 4., p. 533-541.; 2002.

Denton, J. D., Xu, L., 1999, 'The Exploitation of Three-dimensional Flow in Turbomachinery Design', Proceedings of the Institution of Mechanical Engineers, Part C: Journal of Mechanical Engineering, vol. 213, Issue 2, p. 125-137; 1999.

* cited by examiner

GAS TURBINE ANNULAR DIFFUSOR

CROSS REFERENCE TO RELATED APPLICATIONS

This application is the US National Stage of International Application No. PCT/EP2011/065461 filed Sep. 7, 2011 and claims benefit thereof, the entire content of which is hereby incorporated herein by reference. The International Application claims priority to the European application No. 10187887.4 EP filed Oct. 18, 2010, the entire contents of which is hereby incorporated herein by reference.

FIELD OF INVENTION

The present invention relates to the field of gas turbine diffusers.

ART BACKGROUND

In order to enhance structural rigidity of gas turbine diffusers, it is common to find them incorporated with struts or spokes. The struts, typically numbering between three and six, can be either equally spaced circumferentially or non-uniformly distributed around the diffuser annulus at certain axial (or meridional) location. FIG. 1 shows a meridional view of a typical annular diffuser 100 with a strut 102. The strut 102 is an un-cambered airfoil-shaped structure, with a straight leading edge 104 and straight trailing edge 106 perpendicular to an inner diffuser wall 108 and an outer diffuser wall 110. The inner wall 108 and the outer wall 110 define a diffuser annulus 111 of the diffuser 100.

Apart from providing structural support, struts themselves offer no aerodynamic benefit to the diffuser as they create a blockage, depending on their number and thickness, by locally reducing the passage area, which in turn leads to local loss of pressure recovery around the location of the struts and a reduced thermal efficiency.

U.S. 2004/0228726 A1 discloses an exhaust diffuser with struts having their middle portions shifted toward donwstream side, compared with their hub-side and tip-side portions.

EP 1 731 734 A2 discloses a turbofan engine with a high pressure turbine, a low pressure turbine and an annular transition duct therebetween. The duct includes fairings having leading edges extending radially between platforms between which is defined an inlet flow area E for each flow passage.

U.S. Pat. No. 5,338,155 discloses a multi-zone diffuser for a turbo-machine. The diffuser is bound by a hub-end, inner part and an outer part which are connected by a plurality of welded streamlined struts which are fundamentally conical with s/t=constant, where s is the strut chord length and t is the strut pitch.

DE 10 2008 060 847 A1 relates to a turbo-engine with a high-pressure turbine and a low pressure turbine with a flow channel therebetween, the flow channel comprising struts. The leading edge of the struts is inclined in meridian direction.

EP 0 833 060 A2 relates to a blade for an axial fluid machine. The blade is formed to a profile in such a manner that it advances toward a main stream along a stagger line connecting a blade leading edge to a blade trailing edge.

In view of the above-described situation, there exists a need for an improved technique that enables to provide structural support to a gas turbine diffuser, while substantially avoiding or at least reducing one or more of the above-identified problems.

SUMMARY OF THE INVENTION

This need may be met by the subject matter according to the independent claims. Advantageous embodiments of the herein disclosed subject matter are described by the dependent claims.

According to a first aspect of the invention there is provided a Gas turbine diffuser comprising a stream path section for an exhaust stream, the stream path section extending between a section inlet and a section outlet. During operation, the exhaust stream enters the stream path section through the section inlet and exits the stream path section through the section outlet. The stream path section comprises a first wall portion and a second wall portion. The gas turbine diffuser further comprises a strut, the strut having a leading edge extending between the first wall portion and the second wall portion, wherein the leading edge faces the section inlet. The leading edge has a first edge portion and a second edge portion, wherein the second edge portion of the leading edge is located between the first edge portion of the leading edge and the second wall portion. The first edge portion of the leading edge is inclined towards the section outlet with regard to a normal direction perpendicular to the first wall portion at a first leading end point at which the leading edge meets the first wall portion.

This aspect of the invention is based on the idea that by inclining portions or the leading edge toward the section outlet, i.e. in flow direction of the exhaust stream, the Mach number perpendicular to the leading edge of the strut is reduced, resulting in reduced losses.

It should be emphasized that generally herein the term that a first entity is "located between" a second entity and a third entity includes, but does not necessarily imply that the first entity is connected to the second entity and/or to the third entity. Rather, the term "located between" also includes embodiments where other entities are located between the first entity and the second entity and/or between the first entity and the third entity. For example, the wording "the second edge portion of the leading edge being located between the first edge portion of the leading edge and second wall portion" includes an embodiment where the second edge portion of the leading edge is connecting the first edge portion and the second wall, as well as e.g. an embodiment where a third edge portion of the leading edge is located between the first edge portion of the leading edge and the second edge portion of the leading edge, just to give one example.

As mentioned before, the second edge portion of the leading edge is located between the first edge portion of the leading edge and the second wall portion. Vice versa, the first edge portion of the leading edge is located between the second edge portion of the leading edge and the first wall portion.

According to an embodiment, the gas turbine diffuser is a gas turbine exhaust diffuser, i.e. a diffuser located downstream the last turbine stage of the gas turbine.

According to an embodiment the first edge portion of the leading edge extends from the first leading end point and the second edge portion of the leading edge extends from the second wall portion. For example, in one embodiment the second edge portion of the leading edge extends from a second leading end point at which the leading edge meets the second wall portion.

According to a further embodiment, the second edge portion of the leading edge is inclined towards the section outlet with regard to a normal direction perpendicular to the second wall portion at the second leading end point.

According to a further embodiment, the strut has a trailing edge extending between the first wall portion and the second wall portion, wherein the trailing edge faces the section outlet. According to a further embodiment, the trailing edge has a first edge portion and a second edge portion, wherein the second edge portion of the trailing edge is located between the first edge portion of the trailing edge and second wall portion. According to a still further embodiment, the first edge portion of the trailing edge is inclined towards the section inlet with regard to a normal direction perpendicular to the first wall portion at a first trailing end point at which the trailing edge meets the first wall portion.

According to a further embodiment, the first edge portion of the trailing edge extends from the first trailing end point; and the second edge portion of the trailing edge extending from the second wall portion. For example, in an embodiment the second edge portion of the trailing edge extends from a second trailing end point at which the trailing edge meets the second wall portion.

According to a further embodiment, the second edge portion of the trailing edge is inclined towards the section inlet with regard to a normal direction perpendicular to the second wall portion at the second trailing end point.

According to an embodiment, an inclination angle between one of the above described edge portions and its respective normal direction is in a range between 15 degrees and 45 degrees, i.e. the inclination value has a value in this range between 15 degrees and 45 degrees. For example, in an embodiment, an inclination angle between the first edge portion of the leading edge and the normal direction perpendicular to the first wall portion at the first leading end point is in a range between 15 degrees and 45 degrees. In another embodiment, an inclination angle between the second edge portion of the leading edge and the normal direction perpendicular to the second wall portion at the second leading end point is in a range between 15 degrees and 45 degrees. In another embodiment, an inclination angle between the first edge portion of the trailing edge and the normal direction perpendicular to the first wall portion at the first trailing end point is in a range between 15 degrees and 45 degrees. In another embodiment, an inclination angle between the second edge portion of the trailing edge and the normal direction perpendicular to the second wall portion at the second trailing end point is in a range between 15 degrees and 45 degrees.

According to still other embodiments one or more of the above referenced inclination angles is in a range between 25 and 35 degrees. In still other embodiments, one or more of the above referenced inclination angles takes another value.

According to an embodiment, at least one of the edge portions (e.g. the first edge portion and/or the second edge portion of the leading edge and/or of the trailing edge) comprises at least one straight portion. In such a case, each straight portion defines an inclination angle. According to other embodiments, at least one of the edge portions comprises or consists of a curved portion. In such a case, each individual point on the curved portion of the respective edge (leading edge or trailing edge) defines via a tangent to the curved portion at the individual point a corresponding inclination angle of the curved portion at the individual point. According to an embodiment at least part of the thus obtained inclination angles are in the above a specified range, e.g. in the range between 15 degrees and 45 degrees.

According to an embodiment, the leading edge has a third edge portion located between the first edge portion of the leading edge and the second edge portion of the leading edge. According to a further embodiment, the third edge portion is a straight edge portion.

According to an embodiment, the first edge portion of the leading edge or, in another embodiment, the first edge portion and the second edge portion of the leading edge extends over 20% to 40% of the distance between the first leading end point and the second leading end point. According to a further embodiment, the first edge portion and/or the second edge portion of the trailing edge extends over 20% to 40% of the distance between the first trailing end point and the second trailing end point.

According to an embodiment, the third edge portion is connecting the first edge portion and the second edge portion of the leading edge.

According to a second aspect of the herein disclosed subject matter, a gas turbine is provided, the gas turbine comprising a gas turbine diffuser according to the first aspect or an embodiment thereof.

In the above there have been described and in the following there will be described exemplary embodiments of the subject matter disclosed herein with reference to a gas turbine diffuser and gas turbine. It has to be pointed out that of course any combination of features relating to different aspects of the herein disclosed subject matter is also possible. In particular, some embodiments are described with reference to gas turbine diffuser claims whereas other embodiments are described with reference to gas turbine claims. However, a person skilled in the art will gather from the above and the following description that, unless otherwise notified, in addition to any combination of features belonging to one aspect also any combination between features relating to different aspects or embodiments, for example even between features of the apparatus type claims and features of the method type claims is considered to be disclosed with this application.

The aspects and embodiments defined above and further aspects and embodiments of the present invention are apparent from the examples to be described hereinafter and are explained with reference to the drawings, but to which the invention is not limited.

DETAILED DESCRIPTION

Figure 1:
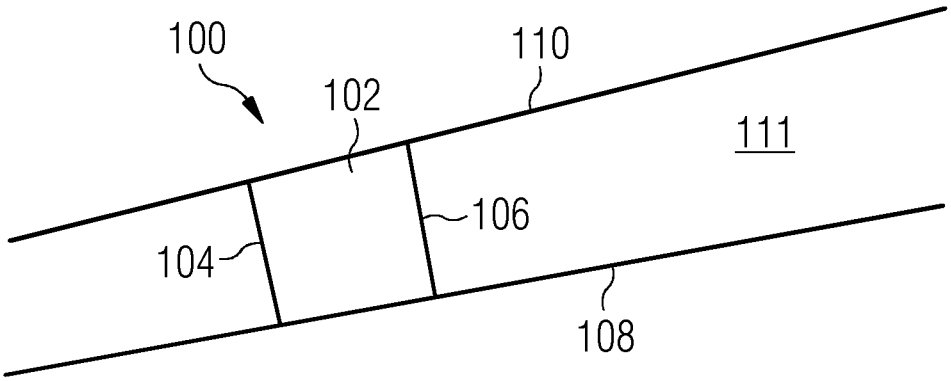
FIG. 1 shows a meridional view of a known annular diffuser.

The illustration in the drawings is schematic. It is noted that in different figures, similar or identical elements are provided with the same reference signs or with reference signs, which are different from the corresponding reference signs only within the first digit.

As mentioned before, apart from providing structural support, struts themselves offer no aerodynamic benefit to the diffuser as they create blockage by locally reducing the passage area, which in turn leads to local loss of pressure recovery around their location. More importantly, an off-design condition, which is characterized by excessive incoming swirling flow (i.e. a high tangential velocity) to the diffuser, leads to flow separation over the surface of the struts, which can degrade the diffuser performance. Loss of pressure recovery in the diffuser itself invariably translates into both loss of power and overall thermal efficiency of the gas turbine.

Embodiments of the herein disclosed subject matter are aimed at mitigating the above performance issues by introducing a compound sweep (leading edge forward sweep and trailing edge backward sweep at both walls of the diffuser) into the design of the diffuser strut. Strut sweep occurs when strut sections are inclined to flow direction, i.e., when leading edge of the swept section is no longer perpendicular to oncoming flow.

The physical effect of sweep can be observed in the way it affects the static pressure distribution over the strut and in particular, the spanwise variation of strut loading (pressure difference between the strut surfaces) within strut passages due to bulk re-distribution of the flow as a result of stream surface twist it introduces.

Figure 2:
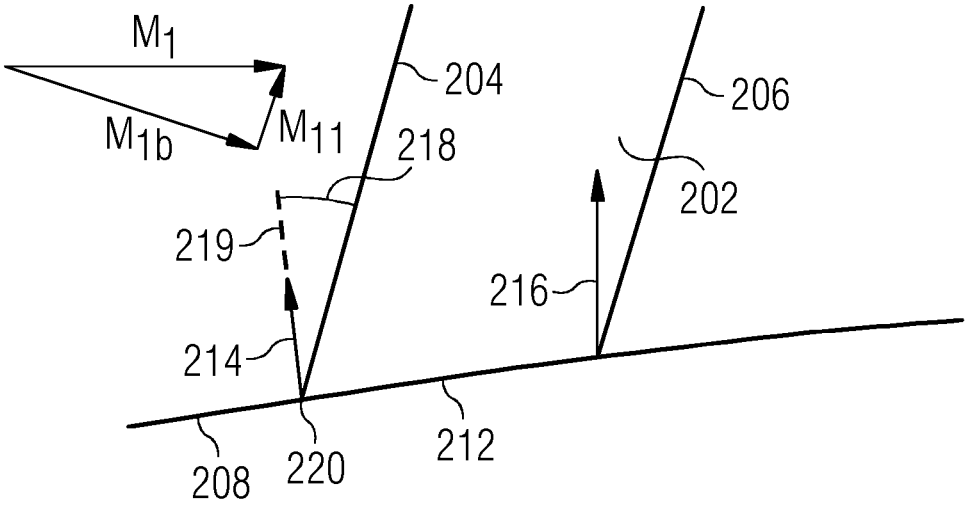
FIG. 2 illustrates a change in Mach number for an inclined leading edge of a strut in accordance with embodiments of the herein disclosed subject matter.

FIG. 2 illustrates the physical effects of swept edge portions 204, 206 of a strut 202, i.e. of the edge portion 204, 206 being inclined with regard to the oncoming exhaust stream. At least in the vicinity of the wall 208 the exhaust stream is assumed to be generally parallel to wall 208. As depicted in FIG. 2, sweeping the strut 202 with regard to the incoming flow of Mach number $M_1$ leads to a reduced Mach number ($M_{1b}$) perpendicular to the blade leading edge, thereby reducing shock losses, but in turn generates a component ($M_{11}$) along the leading edge 204 which may generate some losses but not as significant as the shock loss reduction. As also shown in FIG. 2, a swept forward leading edge 204 would experience low spanwise loading near its endwall 212 facing the wall 208. The converse is true for the trailing edge 206 in FIG. 2. That is, the trailing edge 206 would experience a high spanwise loading near the endwall 212. The low loading of the leading edge 204 is indicated by the arrow 214 in FIG. 2. Similarly, the high loading of the trailing edge 206 is indicated by the arrow 216 in FIG. 2. In this way, sweep can be used to control the blade surface pressure distribution in the endwall region, particularly the axial (or meridional) position of the peak-loading (the highest pressure difference between the blade surfaces in that region).

According to an embodiment, the sweep angle 218 is defined with regard to a normal direction 219 perpendicular to a wall portion of the wall 208 at a first leading end point 220 at which the leading edge meets the wall 208, as illustrated in FIG. 2.

Figure 3:
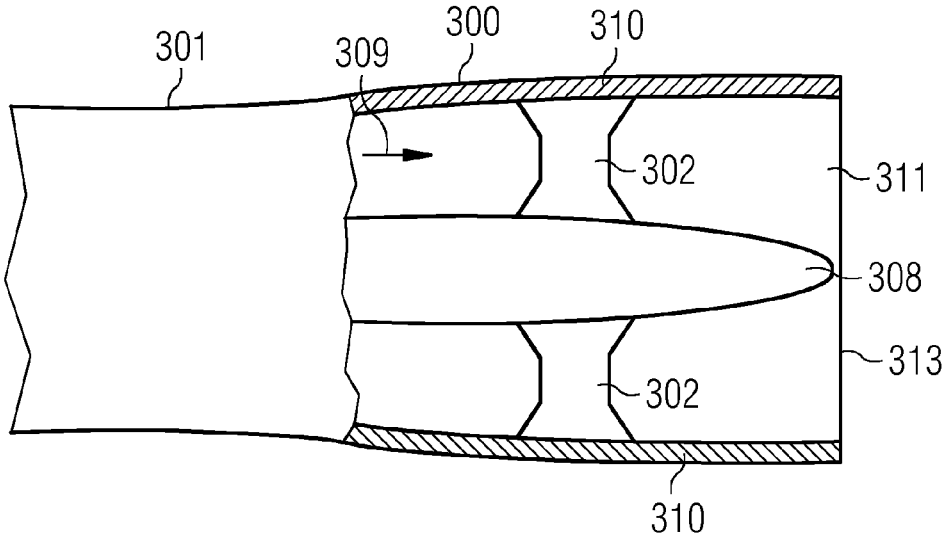
FIG. 3 shows in part a gas turbine in accordance with embodiments of the herein disclosed subject matter.

FIG. 3 shows a part of a gas turbine 301 in accordance with embodiments of the herein discloses subject matter. The gas turbine 301 comprises a gas turbine exhaust diffuser 300 with struts 302 in a diffuser annulus 311 that extends from a diffuser inlet (not shown in FIG. 3) to a diffuser outlet 313. The struts 302 extend between an inner wall 308 and an outer wall 310. The gas turbine 301 generally defines an axial direction 309 along the rotation axis (not shown) of the gas turbine 301. As you see in FIG. 3, the struts 302 may particularly have a concave leading edge and a concave trailing edge.

Figure 4:
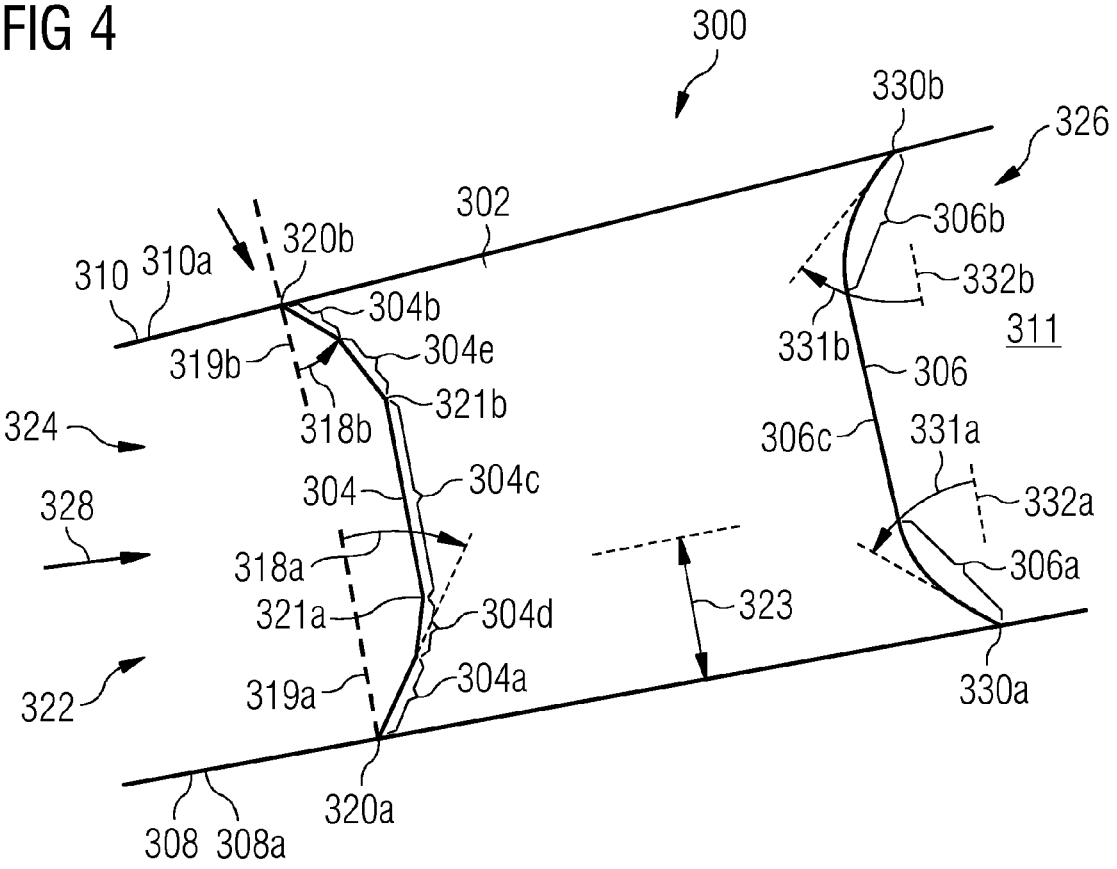
FIG. 4 shows in part a diffuser in accordance with embodiments of the herein disclosed subject matter.

FIG. 4 shows a part of the diffuser 300 of FIG. 3 in more detail. In particular, FIG. 4 shows part of the diffuser annulus 311 with one strut 302. The diffuser annulus 311 in the vicinity of the strut 302 forms a stream path section 322 for an exhaust stream of the gas turbine 301. The stream path section 322 extends between a section inlet 324 and a section outlet 326. It should be mentioned that the section inlet 324 and the section outlet 326 may correspond to the diffuser inlet and the diffuser outlet in one embodiment. In other embodiments the section inlet 324 and the section outlet 326 refer to a section of the diffuser which comprises the strut 302, wherein the exhaust stream enters the section of the diffuser through the section inlet and exits the section through the diffuser outlet.

The stream path section 322 comprises a first wall portion 308*a* of the inner wall 308 and a second wall portion 310*a* of the outer wall 310. The strut 302 has a leading edge 304 extending between the first wall portion 308*a* and the second wall portion 310*a*. The leading edge 304 faces the section inlet 324. In another embodiment the leading edge 304 faces the diffuser inlet (not shown in FIG. 3 and FIG. 4) of the diffuser. The leading edge has a first edge portion 304*a* and a second edge portion 304*b*. The second edge portion 304*b* of the leading edge 304 is located between the first edge portion 304*a* of the leading edge 304 and the second wall portion 310*a*. Likewise, the first edge portion 304*a* of the leading edge 304 is located between the second edge portion 304*b* of the leading edge 304 and the first wall portion 308*a*.

In accordance with an embodiment of the herein disclosed subject matter, the first edge portion 304*a* of the leading edge is inclined by an inclination angle 318*a* (herein also referred to as sweep angle) towards the section outlet 326 with regard to a normal direction 319*a* perpendicular to the first wall portion 308*a* at a first leading end point 320*a* at which the leading edge 304 meets the first wall portion 308*a*.

The second edge portion 304*b* of the leading edge 304 is configured accordingly. In particular, the second edge portion 304*b* of the leading edge 304 is inclined by an inclination angle 318*b* towards the section outlet 326 with regard to a normal direction 319*b* perpendicular to the second wall portion 310*a* at a second leading end point 320*b* at which the leading edge 304 meets the first wall portion 308*a*.

As shown in FIG. 4 and in accordance with an embodiment, the inclination angles 318*a*, 318*b* are in a range between 15 degrees and 45 degrees. According to a further embodiment, the inclination angle 318*a* of the first edge portion 304*a* and the inclination angle 318*b* of the second edge portion 304*b* may be identical.

In accordance with a further embodiment, the leading edge 304 has a third, straight edge portion 304*c* located between the first edge portion 304*a* of the leading edge 304 and the second edge portion 304*b* of the leading edge 304.

In an embodiment shown in FIG. 4, the third edge portion does not extend between (i.e. does not connect to) the first edge portion 304*a* and the second edge portion 304*b*. Rather, in this embodiment an intermediate edge portion 304*d* extends between the first edge portion 304*a* and the third edge portion 304*c* and a further intermediate edge portion 304*e* extends between the second edge portion 304*b* and the third edge portion 304*c*.

According to an embodiment, the all edge portion 304*a*, 304*b*, 304*c*, 304*d*, 304*e* of the leading edge 304 are straight portions, as shown in FIG. 4. According to other embodiments, one or more of the edge portions 304*a*, 304*b*, 304*c*, 304*d*, 304*e* of the leading edge 304 is curved. Curved edge portion can be designed to provide for a smooth surface/profile of the leading edge 304.

According to an embodiment, the straight third edge portion 304*c* is oriented perpendicular to the mid-plane (not shown in FIG. 4) between the first wall portion 308*a* and the second wall portion 310*a*. According to a further embodiment, the straight third edge portion 304*c* is inclined less than a predetermined maximum inclination value with regard to the normal direction 319*a* perpendicular to the first wall portion 308*a* at the first leading end point 320*a* and/or the straight third edge portion 304*c* is inclined less than the predetermined maximum inclination value with regard to the normal direction 319*b* perpendicular to the second wall portion 310*a* at the second leading end point 320*b*. The predetermined maximum inclination value may be for example 7 degrees, or, in another embodiment, 3 degrees. Such a straight third edge portion or an edge portion that is oriented perpendicular to the mid-plane between the first wall portion 308*a* and the second wall portion 310*a* is referred to as non-inclined edge portion.

The points where the non-inclined third edge portion 304*c* meets adjacent edge portions 304*d*, 304*e* that are inclined or curved with regard to the third edge portion 304*c* are referred to as blend points 321*a*, 321*b*. According to an embodiment, the distance 323 between a blend point 321*a*, 321*b* and its closest wall portion 308*a*, 310*a* is in the range between 20% and 40% of the span between the first wall portion 308*a* and the second wall portion 310*a* along the third edge portion 304*c*.

In an embodiment of the herein disclosed subject matter, the leading edge 304 is generally curved towards the section outlet 326 such that the leading edge extends downstream a line between the first leading end point 320*a* and the second leading end point 320*b*. Herein downstream relates to a direction parallel to the flow direction 328 of the exhaust stream. In other words, according to embodiments of the herein disclosed subject matter, the leading edge is configured in a forward sweep, i.e. in a sweep in flow direction of the exhaust stream.

In a further embodiment, the first edge portion 304*a* of the leading edge is the edge portion that meets the first wall portion 308*a*, as shown in FIG. 4. In this case the first leading end point 320*a* is the point at which the first edge portion 304*a* of the leading edge 304 meets the first wall portion 308*a*. Likewise, in a further embodiment, the second edge portion 304*a* of the leading edge is the edge portion that meets the second wall portion 310*a*, as shown in FIG. 4.

In accordance with embodiments of the herein disclosed subject matter, a trailing edge 306 may be configured in accordance with embodiments analogously to the embodiments that are described herein with regard to the trailing edge, except that the trailing edge 306 is generally at least partially curved and/or inclined towards the section inlet 324 such that the trailing edge extends upstream with regard to a line between a first trailing end point 330*a* and a second trailing end point 330*b*. Herein "upstream" relates to a direction opposite the flow direction 328 of the exhaust stream. In other words, according to embodiments of the herein disclosed subject matter, the trailing edge is generally configured in a backward sweep, i.e. in a sweep opposite the flow direction 328 of the exhaust stream.

For example, in an embodiment, analogous to the leading end points 320*a*, 320*b*, the first trailing end point 330*a* is defined as the point at which the trailing edge 306 meets the first wall portion 308*a* and the second trailing end point 330*b* is defined as the point at which the trailing edge meets the second wall portion 310*a*.

According to an embodiment shown in FIG. 4, the trailing edge 306, extending between the first wall portion 308*a* and the second wall portion 310*a*, faces the section outlet 326. In another embodiment, also shown in FIG. 4, the trailing edge 306 faces the diffuser outlet 313 (see FIG. 3) of the diffuser 300. In accordance with an embodiment, the trailing edge has a first edge portion 306*a* and a second edge portion 306*b*. The second edge portion 306*b* of the trailing edge 306 is located between the first edge portion 306*a* of the trailing edge 306 and second wall portion 310*a*. Likewise the first edge portion 306*a* of the trailing edge 306 is located between the second edge portion 306*b* of the trailing edge 306 and first wall portion 308*a*.

In accordance with a further embodiment, the first edge portion 306*a* of the trailing edge 306 is inclined, by an angle 331*a*, towards the section inlet 324 with regard to a normal direction 332*a* perpendicular to the first wall portion 308*a* at the first trailing end point 330*a* at which the trailing edge 306 meets the first wall portion 308*a*.

In accordance with a further embodiment, the second edge portion 306*b* of the trailing edge 306 is inclined, by an angle 331*b*, towards the section inlet 324 with regard to a normal direction 332*b* perpendicular to the second wall portion at the second trailing end point 330*b* at which the trailing edge meets 306 the second wall portion 310*a*.

According to an embodiment the first edge portion 306*a*, the second edge portion 306*b* or, as shown in FIG. 4, both, the first and the second edge portion 306*a*, 306*b* of the trailing edge 306 may be configured as a curved edge portion. In such an embodiment, each point on the curved edge portion 306*a*, 306*b* defines an inclination angle between the tangent at this point and the corresponding normal direction 332*a*, 332*b*, respectively, at the trailing end point 330*a*, 330*b* where the curved edge portion 306*a*, 306*b* meets the first or the second wall portion 308*a*, 310*a*, from which it extends.

Similar to the leading edge 304, the trailing edge 306 also comprises a third edge portion 306*c*, which in an illustrated embodiment is a straight edge portion.

In other embodiments, the first and second edge portions of an edge (leading edge 304 or trailing edge 306) extend to each other with no further edge portion inbetween. In other words, in such embodiments the edge consists of the first edge portion and the second edge portion.

Another design parameter of the strut according to the herein disclosed subject matter is the orientation of the strut or sections thereof with regard to the axial direction 309 of the diffuser or of the gas turbine (see FIG. 3).

In an embodiment shown in FIG. 4, as shown in FIG. 4, the outer wall 310 and the inner wall 308 are, when seen in a cross sectional view as FIG. 4, substantially straight without a curvature. I.e. the surfaces of the outer wall 310 and the inner wall 308 are substantially conical. As shown in FIG. 4, the outer wall 310 and the inner wall 308 may even be substantially parallel to each other with an increment—a minor increment—in distance along the axial length of the diffuser 300.

Figure 5:
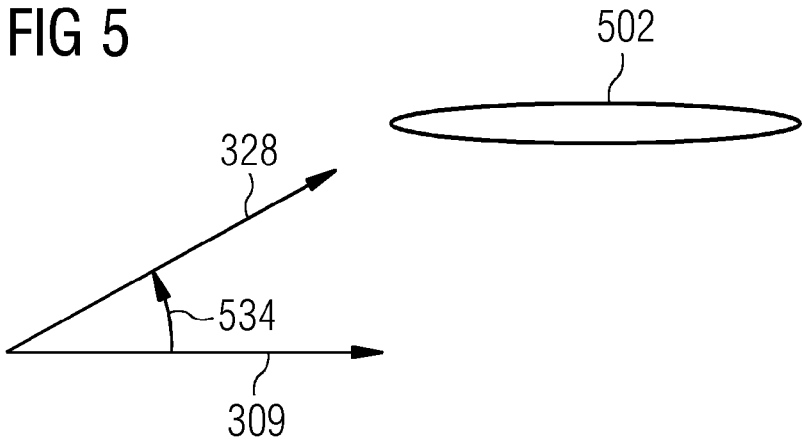
FIG. 5 shows a diffuser strut section in accordance with embodiments of the herein disclosed subject matter.

FIG. 5 shows, in a cross sectional view, an unstaggered strut section 502 according to embodiments of the herein disclosed subject matter. The unstaggered strut section 502 is aligned with the axial direction 309 (also illustrated in FIG. 3).

Further shown in FIG. 5 is the flow direction 328 of the exhaust stream for a specific operating condition, in particular for a specific load, of the gas turbine. Usually, a gas turbine is designed to operate best at a predetermined condition, the so-called design condition. The struts are designed to be aligned with the flow direction at the design condition. However, if e.g. the load of the gas turbine changes, the flow direction changes and at least a portion of the strut is no longer aligned with the flow direction of the exhaust stream. This is shown in FIG. 5, where the direction of the strut section 502 is not aligned with the flow direction 328. Rather, the flow direction 328 deviates by a swirl angle 534 from the orientation of the strut section 502 (which is aligned with the axial direction 309).

Figure 6:
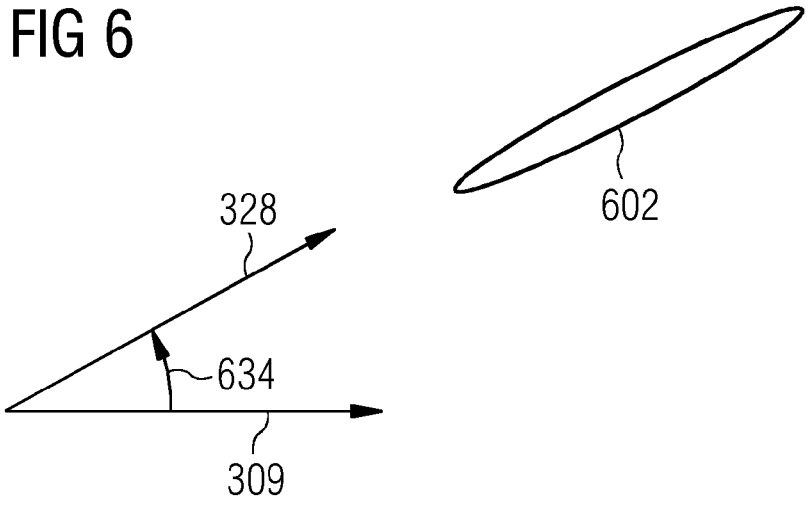
FIG. 6 shows a further diffuser strut section in accordance with embodiments of the herein disclosed subject matter.

FIG. 6 shows, in a cross sectional view, a staggered strut section 602 according to embodiments of the herein disclosed subject matter. The staggered strut section 602 is inclined with regard to the axial direction 309 by a swirl angle 634. At the operating condition illustrated in FIG. 6, the flow direction 328 of the exhaust stream is aligned with strut section 602, i.e. in FIG. 6 the gas turbine is at design condition.

According to an embodiment, the strut is not twisted. For example, in another embodiment, cross sections of the strut at different distances from the first wall portion or, in another embodiment, longitudinal directions of cross sections of the strut at different distances from the first wall portion are aligned parallel to each other. Hence in an embodiment the whole strut is rotated (staggered) with regard to the axial direction.

Figure 7:
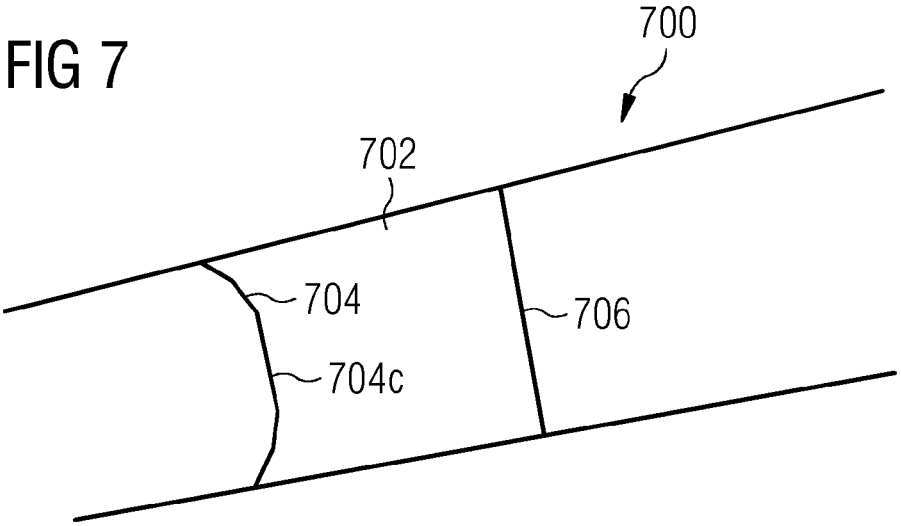
FIG. 7 shows in part a further diffuser in accordance with embodiments of the herein disclosed subject matter.

FIG. 7 shows part of a further gas turbine diffuser 700 in accordance with embodiments of the herein disclosed subject matter.

The leading edge 704, comprising the non-inclined third edge portion 704*c* of the strut 702 of the gas turbine diffuser 700 is configured identical to the leading edge 304 of the strut 302 of the gas turbine diffuser 300 in FIG. 3 and the description thereof is not repeated here.

In contrast to the strut 302 in FIG. 3, the strut 702 comprises a trailing edge 706 that is straight and, in an embodiment, parallel to the non-inclined third edge portion 704*c* of the leading edge 704 of the strut 702.

According to an embodiment, the first wall or first wall portion is an inner wall/inner wall portion of gas turbine diffuser, e.g. the wall or wall portion of a hub. According to a further embodiment, the second wall or second wall portion is an outer wall/outer wall portion of gas turbine diffuser, e.g. the wall or wall portion of a casing.

The effect of compound-swept strut (i.e. sweep is applied to both upper and lower wall sections of the strut, as illustrated in FIG. 4) on the diffuser performance has been illustrated with 3D computational fluid dynamics (CFD) calculations on a 60 degrees sector of a gas turbine diffuser passage with six struts. In this case, the periodic boundary of the passage extends over each of the two surfaces of the strut. The compound sweep was performed by extending the chords of the near-wall sections of the strut, resulting in about 25 degrees sweep angle, which blends back with the remaining un-swept sections at approximately 20% span from both walls. The computations were performed at design condition and also at an off-design condition where +12 degrees extra swirl was imposed on the design inlet swirl distribution, which consequently leads to a swirl angle of about 32 degrees near the lower wall and 18 degrees around the mid-span. The results are compared with those of similar calculations with straight struts of identical profile sections and with chord lengths as those of the un-swept sections. Both struts (swept and straight) are un-staggered.

Figure 8A:
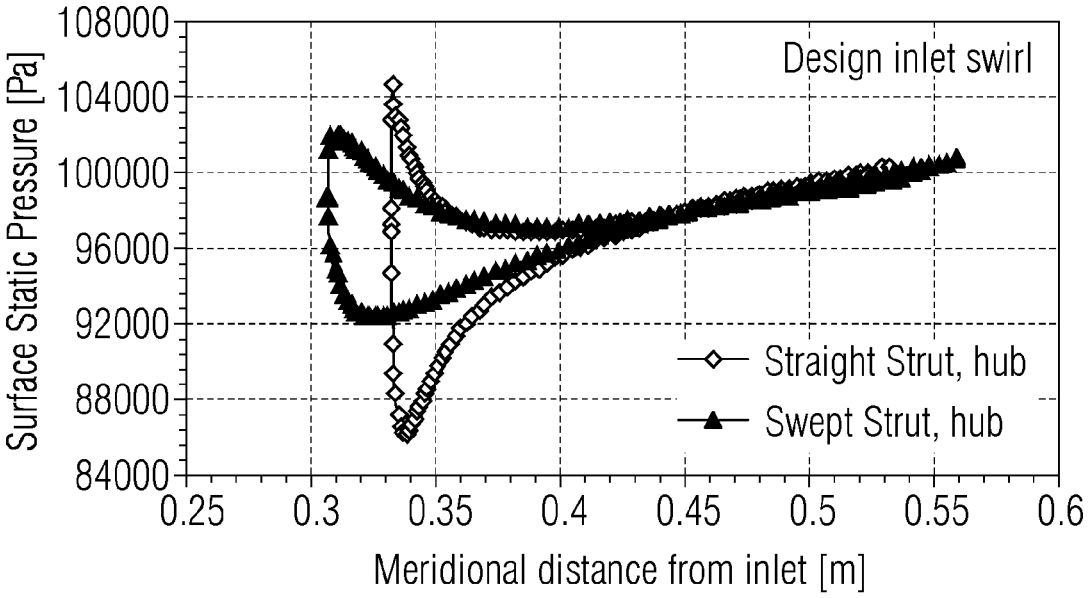
FIG. 8*a* to FIG. 8*c* show a surface static pressure distribution for a swept strut according to embodiments of the herein disclosed subject matter in comparison to a straight strut for at different distances from an inner wall of the diffuser at design condition.

Results of the CFD calculations are shown in FIG. 8*a* to FIG. 11. FIG. 8*a* to FIG. 8*c* show the surface static pressure distributions on the struts at the leading edge near the lower wall (i.e. the hub) of the diffuser (region of the swept sections) over the meridional distance from the diffuser inlet at the design condition for different distances from the lower wall. FIG. 8*a* shows the surface static pressure distribution at the lower wall (hub) for a straight strut and for the swept strut with about 25 degrees sweep angle. FIG. 8*b* shows the respective surface static pressure distributions at a distance from the lower wall of 5% of the span between upper and lower wall. FIG. 8*c* shows the respective surface static pressure distribution at a distance from the lower wall of 11% of the span between upper and lower wall. As is apparent from FIG. 8*a* to FIG. 8*c*, in particular at the lower wall the pressure variation is reduced for the swept strut compared to the straight strut.

Figure 8B:
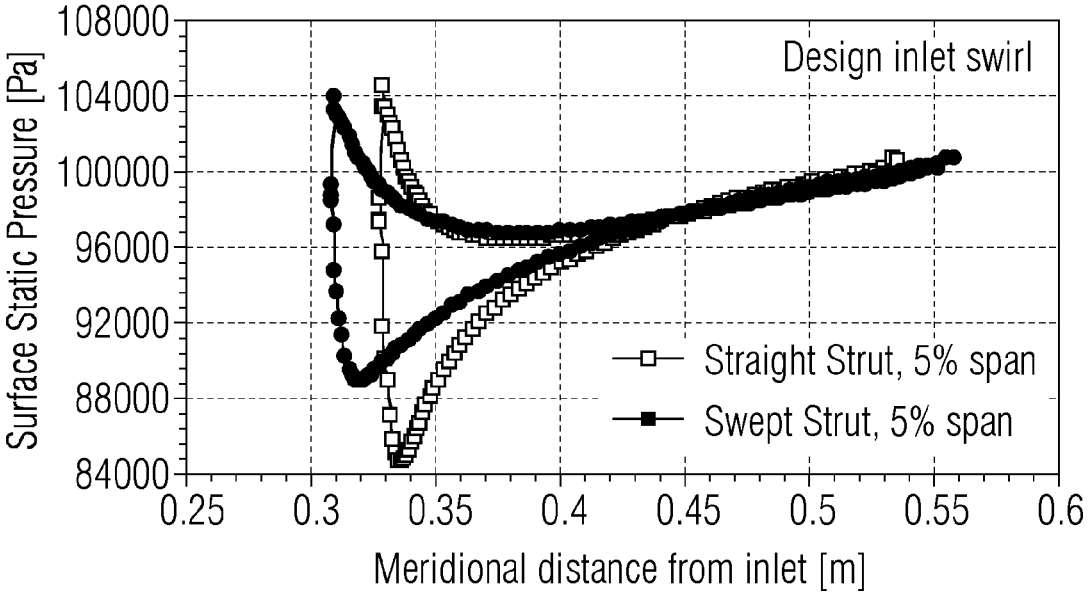
Figure 8C:
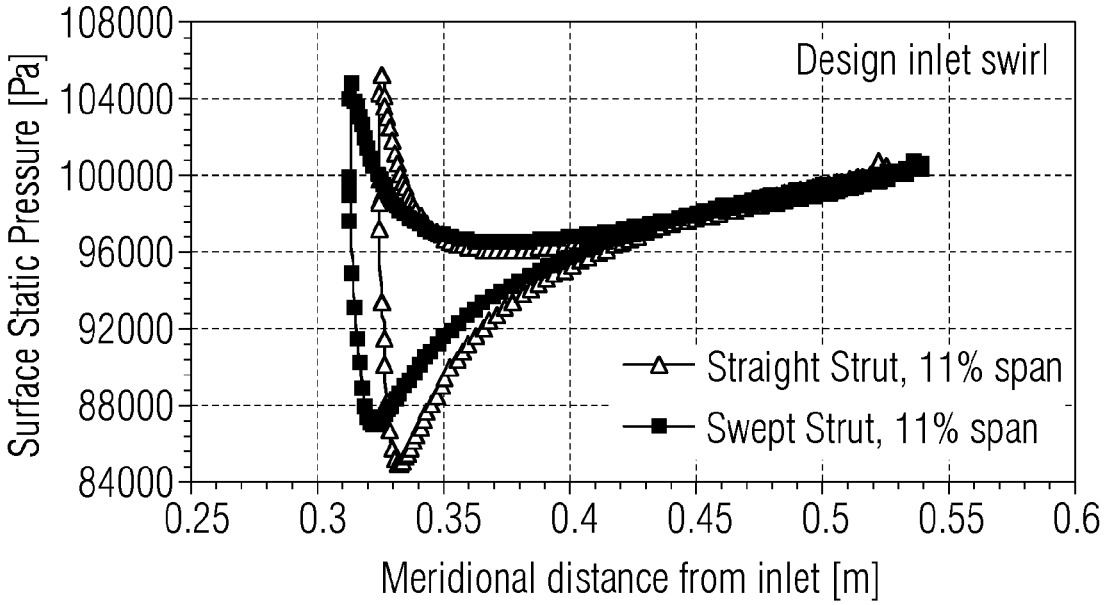
Figure 9A:
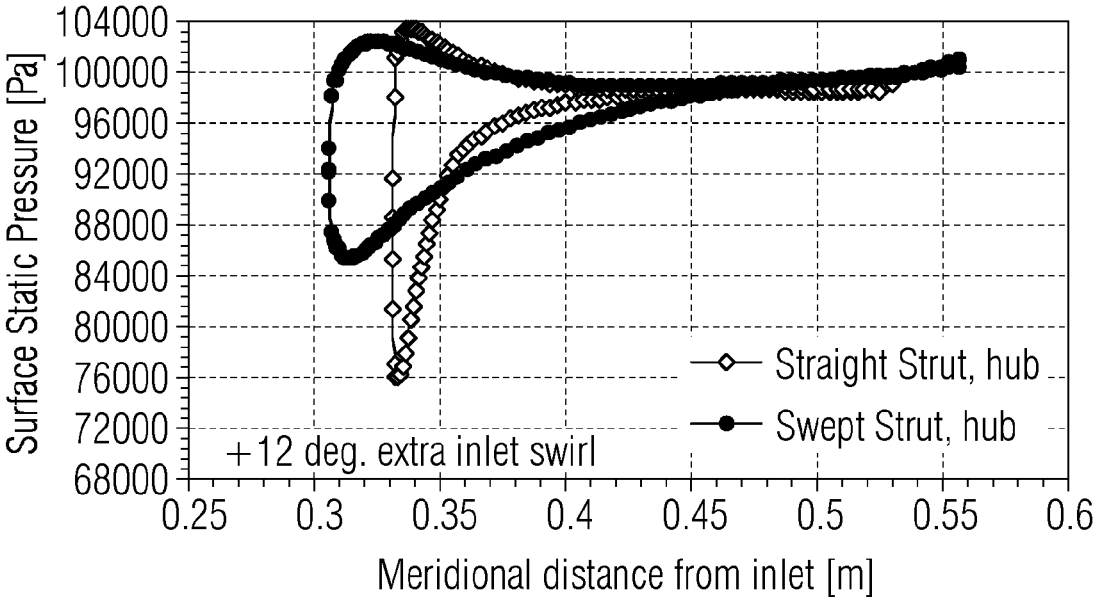
FIG. 9*a* to FIG. 9*c* show a surface static pressure distribution for a swept strut according to embodiments of the herein disclosed subject matter in comparison to a straight strut for at different distances from an inner wall of the diffuser at off-design condition with an extra 12 degrees inlet swirl.
Figure 9B:
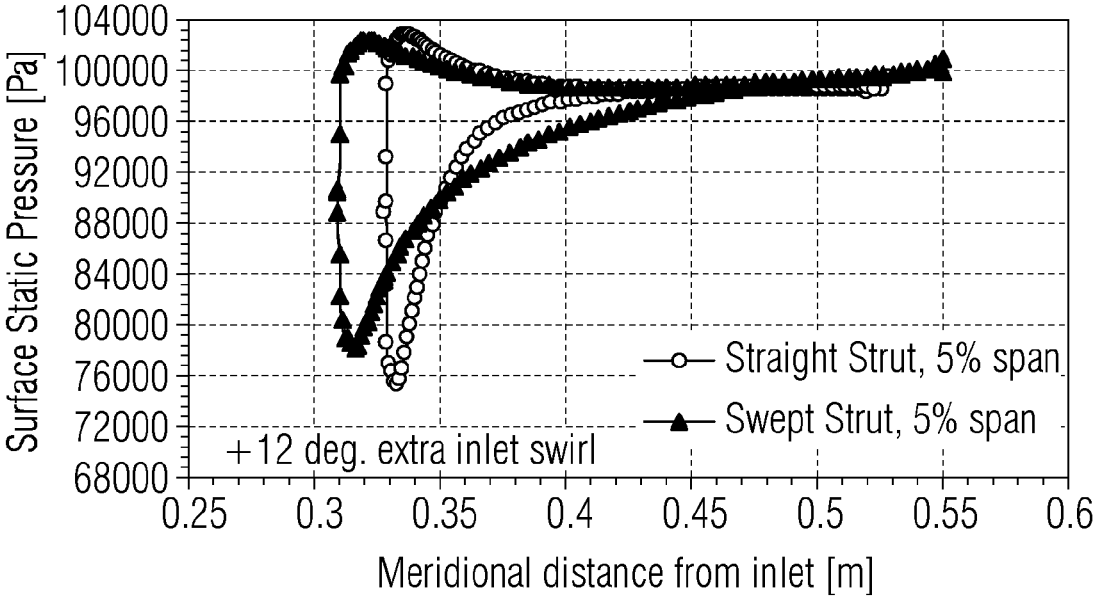
Figure 9C:
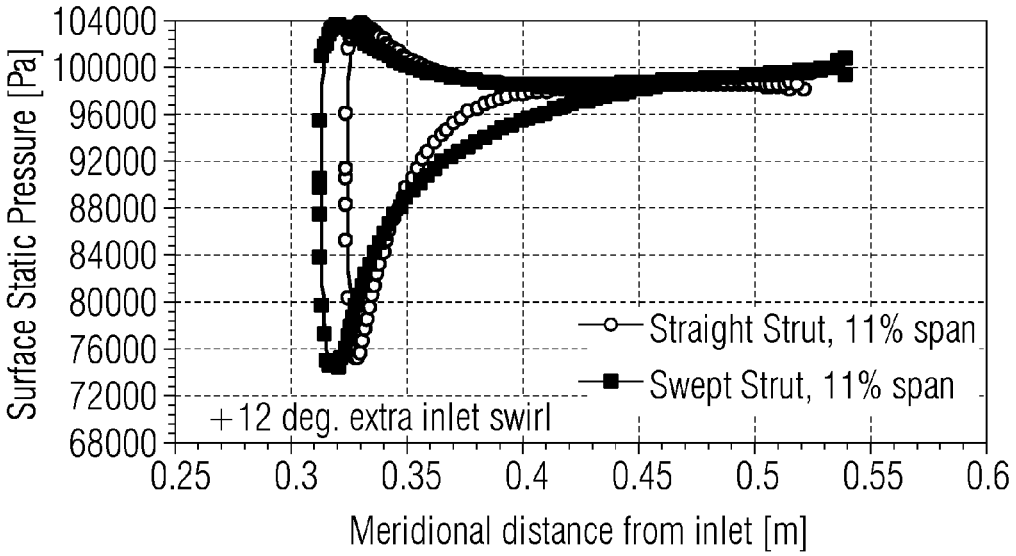

The conditions for which FIG. 9*a* to FIG. 9*c* have been obtained correspond to those of FIG. 8*a* to FIG. 8*c* except that the surface static pressure distributions have been calculated at off-design condition with the imposed 12 degrees of extra inlet swirl. It can be seen that the 3D effect of the compound sweep minimises the adverse pressure gradient by reducing the flow acceleration over the strut with a net increase in pressure in the forward region compared to the straight strut.

Figure 10A:
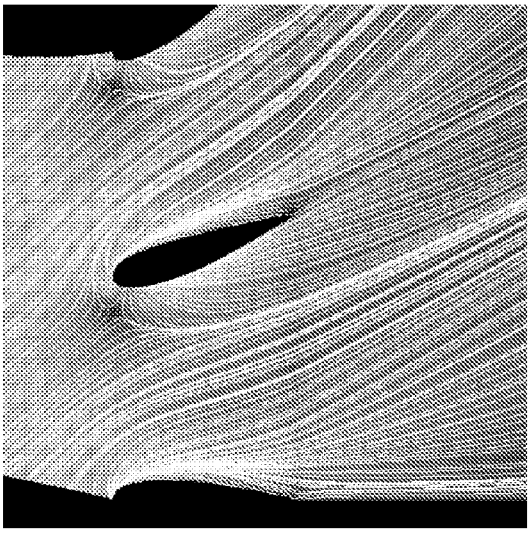
FIG. 10*a* shows the flow of an exhaust stream for the configuration of FIG. 9*a* for a swept strut.
Figure 10B:
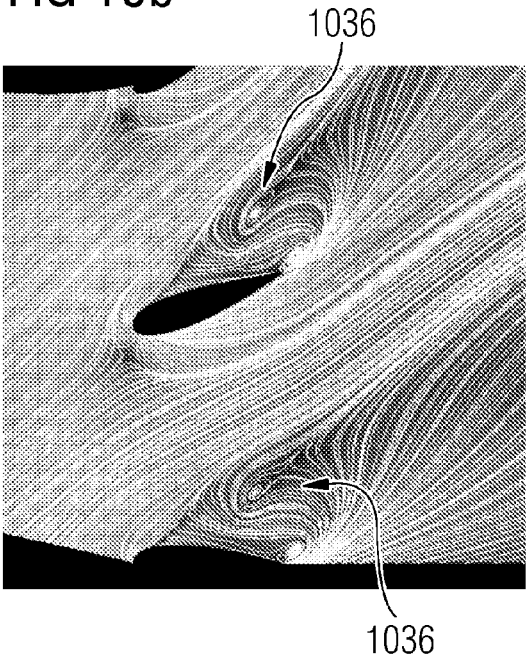
FIG. 10*b* shows the flow of an exhaust stream for the configuration of FIG. 9*a* for a straight strut.

FIG. 10*a* illustrates the flow over the swept strut at the inner diffuser wall (hub) as described with regard to FIG. 9*a* to FIG. 9*c* at off-design condition with 12 degrees extra swirl imposed on the design inlet swirl profile. In contrast, FIG. 10*b* shows the flow for same conditions except that a straight strut has been used.

As FIG. 10*a* illustrates, even at off-design condition the swept strut does not result in a reverse flow and the applied sweep results in a separation-free diffuser wall and very much minimised and delayed separation of the flow over the surface of the strut. On the other hand, as is apparent from FIG. 10*b*, large separation can be observed on both the diffuser wall and the surface of the straight strut, and because of this, flow turning or swirl reduction across the strut could no longer be sustained in the region of the straight strut, leading to reverse flow, indicated at 1036 in FIG. 10*b*.

Figure 11:
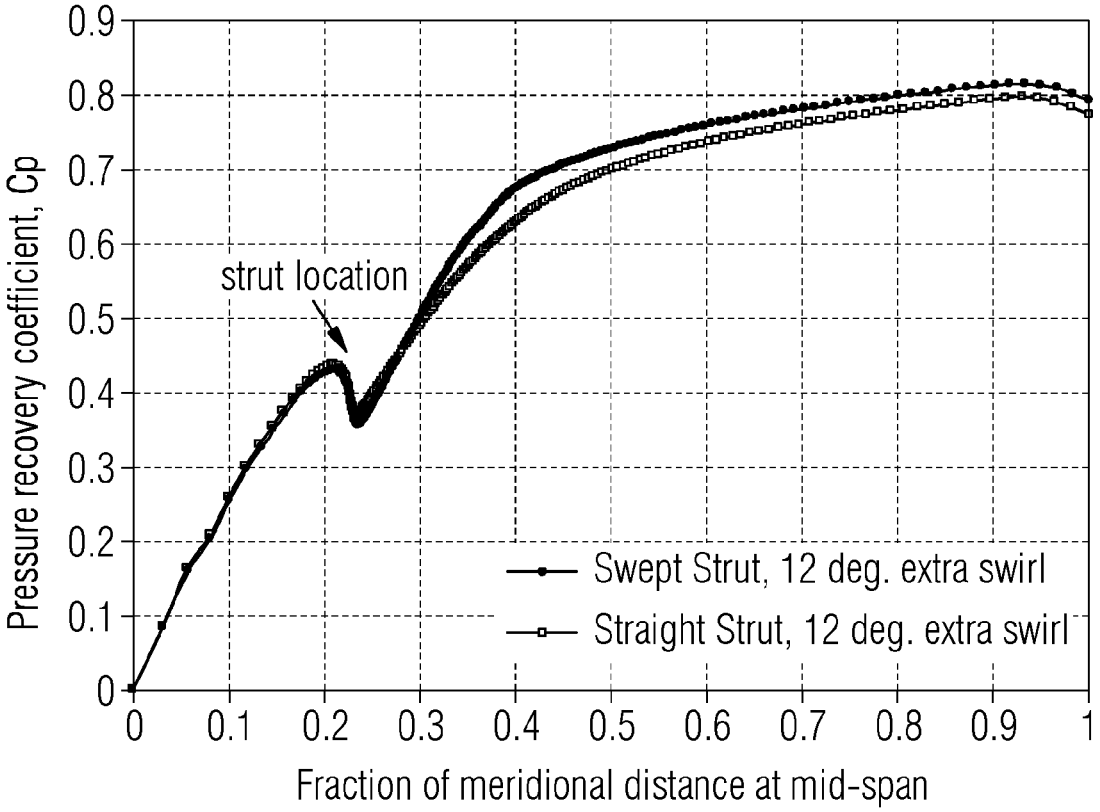
FIG. 11 shows the pressure recovery coefficient of a diffuser with swept struts and for a diffuser with straight struts over the normalized meridional distance from the diffuser inlet.

The variation of the overall 1-D averaged static pressure recovery coefficient, Cp (which is a normalized pressure given as $C_p=(P-P_1)/(P_{01}-P_1)$, where P is the local average static pressure, P1 is the average static pressure at the inlet of the diffuser, P01 is the average total pressure at the inlet of the diffuser), along the meridional length of the diffuser with both types of struts at off-design condition, is shown in FIG. 11. In contrast to the straight strut, the overall pressure recovery can be seen to be more enhanced in the diffuser with the swept strut, right from downstream of the strut, due to the improved flow behaviour in the passage of the diffuser.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state:

Described is a gas turbine diffuser comprising a strut with a leading edge extending between a first wall portion and a second wall portion, wherein a first edge portion of the leading edge is inclined towards a diffuser section outlet, i.e. in flow direction of an exhaust stream, with regard to a normal direction perpendicular to the first wall portion at a first leading end point at which the leading edge meets the first wall portion. Hence the leading edge is partially inclined towards a diffuser section outlet.

The invention claimed is:

1. A gas turbine, comprising:

a gas turbine diffuser wherein the gas turbine diffuser is a gas turbine exhaust diffuser located downstream a last turbine stage of the gas turbine, the gas turbine diffuser comprising:

a stream path section for an exhaust stream, the stream path section extending between a section inlet and a section outlet, the stream path section comprising a first wall portion and a second wall portion;

a strut, the strut having a leading edge extending between the first wall portion and the second wall portion, the leading edge facing the section inlet;

the leading edge having a first edge portion and a second edge portion, the second edge portion of the leading edge being located between the first edge portion of the leading edge and the second wall portion;

a first leading end point, at which the leading edge meets the first wall portion; and a second leading end point, at which the leading edge meets the second wall portion;

the leading edge having a third, straight edge portion located between the first edge portion of the leading edge and the second edge portion of the leading edge;

the first edge portion of the leading edge extending over 20% to 40% of the distance between the first leading end point and the second leading end point;

the first edge portion of the leading edge being inclined towards the section outlet with regard to a normal direction perpendicular to the first wall portion at the first leading end point, thereby reducing the mach number perpendicular to the leading edge; and the second edge portion of the leading edge being inclined towards the section outlet with regard to a normal direction perpendicular to the second wall portion at the second leading end point at which the leading edge meets the second wall portion; and the leading edge further comprising an intermediate edge portion extending between the first edge portion and the third straight edge portion and a further intermediate edge portion extending between the second edge portion and the third straight edge portion, wherein all the edge portions of the leading edge are straight portions.

2. The gas turbine according to claim 1, the gas turbine diffuser further comprising:

the first edge portion of the leading edge extending from the first leading end point; and the second edge portion of the leading edge extending from the second wall portion.

3. The gas turbine according to claim 1, the gas turbine diffuser further comprising:

the strut having a trailing edge extending between the first wall portion and the second wall portion, the trailing edge facing the section outlet;

the trailing edge having a first edge portion and a second edge portion, the second edge portion of the trailing edge being located between the first edge portion of the trailing edge and second wall portion;

the first edge portion of the trailing edge being inclined towards the section inlet with regard to a normal direction perpendicular to the first wall portion at a first trailing end point at which the trailing edge meets the first wall portion.

4. The gas turbine according to claim 3, the gas turbine diffuser further comprising:

the first edge portion of the trailing edge extending from the first trailing end point; and the second edge portion of the trailing edge extending from the second wall portion.

5. The gas turbine according to claim 3, the gas turbine diffuser further comprising:

the second edge portion of the trailing edge being inclined towards the section inlet with regard to a normal direction perpendicular to the second wall portion at a second trailing end point at which the trailing edge meets the second wall portion.

6. The gas turbine according to claim 1, wherein an inclination angle between the first edge portion of the leading edge and the normal direction perpendicular to the first wall portion at the first leading end point is in a range between 15 degrees and 45 degrees.

7. The gas turbine according to claim 1, wherein the third edge portion is connecting the first edge portion and the second edge portion of the leading edge.

* * * * *